United States Patent [19]

Quigley

[11] 4,204,104

[45] May 20, 1980

[54] SLIDE SWITCH

[75] Inventor: Thomas J. Quigley, Farmville, Va.

[73] Assignee: Stackpole Components Company, Raleigh, N.C.

[21] Appl. No.: 956,177

[22] Filed: Oct. 30, 1978

[51] Int. Cl.[2] ..... H01H 1/44; H01H 9/00; H01H 15/24

[52] U.S. Cl. ..... 200/164 R; 174/51 M; 200/16 D; 200/260

[58] Field of Search ..... 200/16 C, 16 D, 164 R, 200/260, 290, 305; 174/51

[56] References Cited

U.S. PATENT DOCUMENTS

| | | | |
|---|---|---|---|
| 2,762,880 | 9/1956 | Hathorn et al. | 200/16 D X |
| 3,316,364 | 4/1967 | Schink | 200/16 C |
| 3,316,365 | 4/1967 | Cobb | 200/16 C |
| 3,329,778 | 7/1967 | Bedols | 200/16 C |
| 3,987,263 | 10/1976 | Ogasawara | 200/16 D X |
| 4,121,062 | 10/1978 | Fujino | 200/16 D X |

*Primary Examiner*—Stephen Marcus
*Attorney, Agent, or Firm*—Brown, Flick & Peckham

[57] ABSTRACT

A row of three stationary electric contacts is mounted on an insulating base for a metal housing in which a bridging contact carried by an insulating slider is movable lengthwise of the row from a position bridging the middle stationary contact and either of the end contacts to a position bridging the metal contact and the other end contact. When the bridging contact is moved into engagement with an end contact the slider also moves a metal grounding contact into engagement with the end contact that is not engaged by the bridging contact at that time, whereby the end contact engaged by the grounding contact is electrically connected by it to the metal housing which the grounding contact always engages.

8 Claims, 6 Drawing Figures

SLIDE SWITCH

When a TV game is connected with a television receiver, the game radio frequency signal may be radiated from the television antenna at a strength in excess of FCC regulations. Also, when a television receiver is fed by two cables of TV cable systems, the cable that is not being used but that is carrying a program may produce a signal strong enough to interfere with the pictures being received from the other cable.

Accordingly, it is an object of this invention to provide an electric switch of simple construction which will reduce to zero the signal radiated by a TV game, and which will reduce the signal produced by either of a pair of cables in TV cable systems connected to the same television receiver to a point where the signal will not interfere with the desired program. Another object is to provide such a switch, in which a pair of unused contacts can be shorted.

The preferred embodiment of the invention is illustrated in the accompanying drawings, in which FIG. 1 is a plan view;

Figure 5:
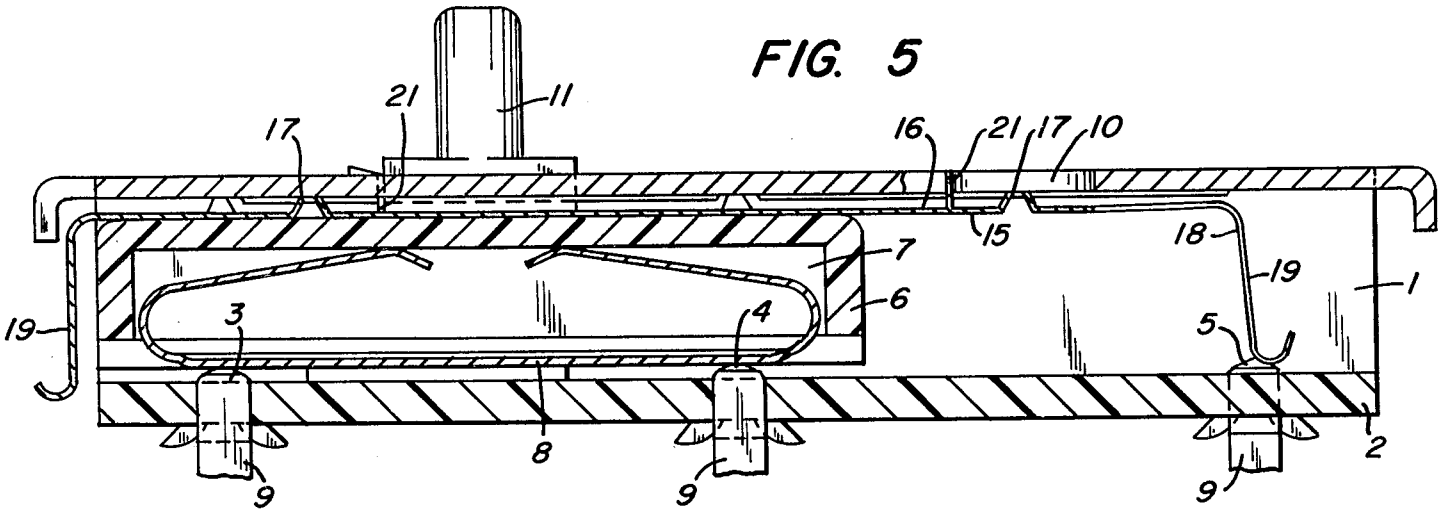
FIG. 5 is an enlarged longitudinal section taken on the line V—V of FIG. 1.
Figure 6:
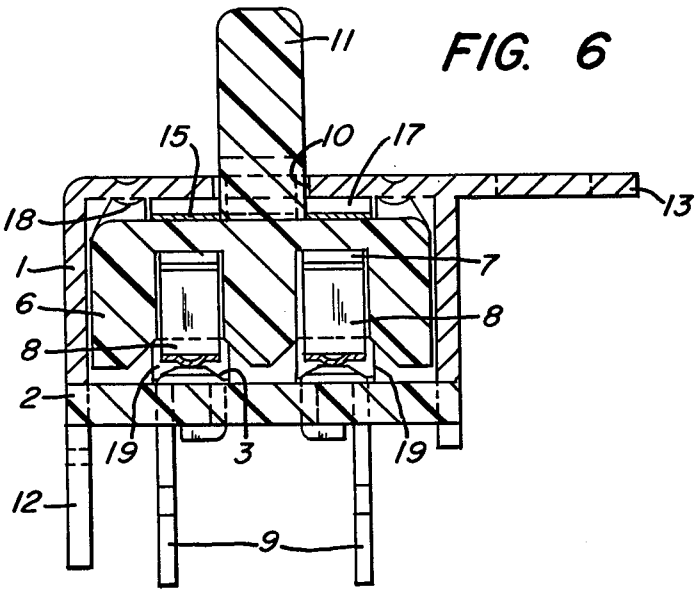
FIG. 6 is an enlarged cross section taken on the line VI—VI of FIG. 2.

Referring to the drawings, an elongated switch case is formed from metal channel-shape housing 1, the bottom of which is closed by an insulating base 2 in the usual manner. Rigidly mounted on the base inside the case are two parallel rows of electrical contacts, there being three contacts 3, 4 and 5 in each row spaced apart lengthwise of the base as shown in FIG. 5. Also inside the case there is a rectangular slider 6 made of insulating material, such as a plastic, and provided with two parallel recesses 7 extending lengthwise of the case and open at their bottoms. In each of these recesses there is a bridging contact 8 formed from a resilient metal strip having a straight central body portion, from the ends of which integral legs are inclined upwardly toward each other. The slider recesses are in such positions that when the slider is moved lengthwise of the case it will move the bridging contacts across the fixed contacts. In one extreme position of the slider the bridging contacts will bridge the middle fixed contacts 4 and the contacts at one end of the insulating base, such as contacts 3, and in the other extreme position of the slider the two middle contacts and the other two end contacts 5 will be bridged by the sliding contacts. The six fixed contacts are connected with the desired electric circuits by means of terminals 9 extending through the base.

To permit the slider to be moved, the top of the case is provided with a longitudinal slot 10, through which a central button 11 on the slider extends.

It is a feature of this invention that the pair of fixed end contacts not engaged at the time by the bridging contacts can be grounded. Accordingly, a metal grounding contact member is disposed in the case and is moved by the slider into engagement with the pair of end contacts not engaged at the time by the bridging contacts. The grounding contact engages the metal housing at all times, and the housing can be connected to ground through a lug 12 projecting from its lower edge, or through tongues 13 struck out of the sides of the housing.

The grounding contact preferably is a metal strip provided with a body portion 15 disposed between the slider 6 and the top side of the metal housing, which the strip engages. This body portion has a central longitudinal slot 16 in it directly below housing slot 10, with the slider button 11 extending through both slots. To stiffen the body portion 15 of the strip and reduce friction between it and the case, the body portion is provided at each end of its slot with a transverse ridge 17 pressed out of the strip. These ridges slide along the top side of the housing between longitudinal ridges 18 struck downwardly from that side. Beyond the strip ridges 17 the strip is bifurcated to provide two laterally spaced contact fingers 19 at each end of the strip. Each pair of fingers is bent downwardly across an end of the slider, and each finger has a reversely bent lower end for engaging one of the fixed end contacts on the base member.

Figure 1:
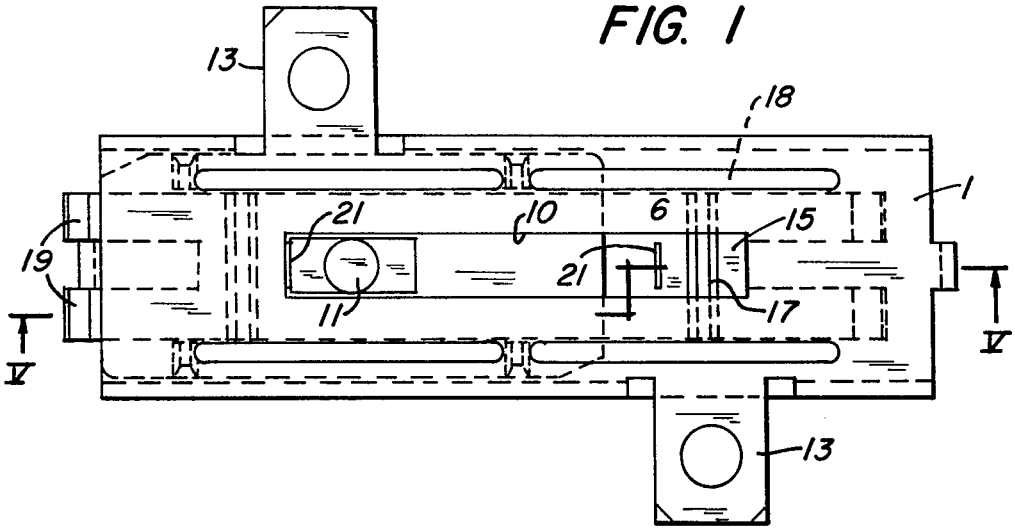
Figure 2:
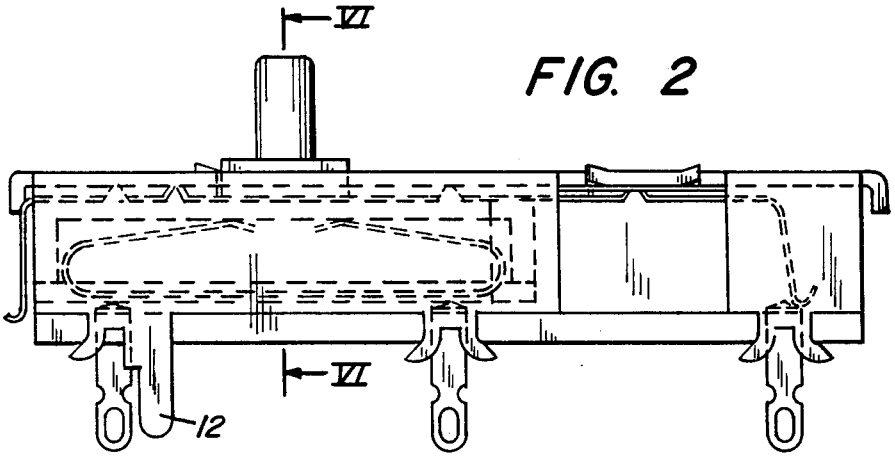
FIG. 2 is a side view.
Figure 3:
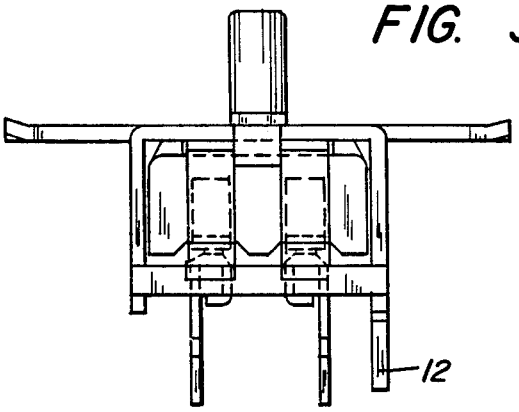
FIG. 3 is an end view.
Figure 4:
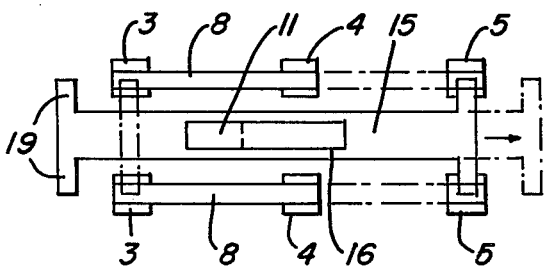
FIG. 4 illustrates schematically the two extreme positions of the grounding member.

The slot 16 in the top of the grounding contact is shorter than the housing slot so that after the slider button has been moved a predetermined distance without moving the grounding contact it will then engage the end of the slot 16 and move the grounding contact a short distance. This distance is just sufficient to pull the grounding contact fingers 19 located at the opposite end of the case, and which were disposed outwardly beyond the fixed contacts at that end of the case, into engagement with those fixed contacts, such as contacts 5 in FIG. 5. Simultaneously, the slider moves the bridging contacts 8, which are always in engagement with middle contacts 4, into engagement with the other pair of end contacts (contacts 3 in FIG. 5) to electrically connect them with the middle contacts 4. Movement of the slider the full distance in the opposite direction will ground the other pair of end contacts while connecting the first pair of end contacts into the circuits. These two positions of the grounding contact and the corresponding positions of the bridging contacts are illustrated schematically in FIG. 4.

Although the ends of the grounding member slot 16 may form the abutments engaged by the slider button, it is preferred to bend a tab 21 out of each end of the slot and extend it through the case slot to increase the area of the abutment engaged by the button. Also, in the preferred form the length of the contact fingers 19 is such that the pair of them that are not engaging fixed contacts will overlie the adjoining end face of the insulating base slightly as shown at the left-hand end of FIG. 5, thereby requiring those fingers to be put under tension when drawn into the case for engaging the adjacent fixed contacts 3.

In some situations it may be desirable to ground the contacts at only one end of the case, which can be done by cutting off the lower ends of one pair of contact fingers 19 so that they cannot engage the end contacts at that end of the case.

It also may be desirable for some applications to provide a switch with only one row of fixed contacts, and one bridging contact. In that case, either of the end contacts can be grounded by a slidable grounding contact in the same way as explained above.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A slide switch comprising an elongated case formed from a metal housing provided in one side with a longitudinal slot and also provided with an insulating base, a row of three fixed electric contacts inside the case spaced apart lengthwise of said base and rigidly mounted thereon, an insulating slider inside the case provided with an actuating button extending through said slot for moving the slider back and forth in the case, a bridging contact movable by the slider from a position bridging the middle stationary contact and either of the end stationary contacts to a position bridging the middle contact and the other end contact, and a metal grounding contact in the case in engagement with said housing and movable by the slider into engagement with one end contact when the bridging contact is moved into engagement with the other end contact, said grounding contact being longer than the slider and having an abutment at each side of said button in its path of movement, and the distance between said abutments being such that when the button is moved toward said other end contact a predetermined distance it will engage one of said abutments and then push it in the same direction far enough to pull said grounding contact into engagement with said one end contact at the opposite end of the case, whereby the end contact engaged by the grounding contact is electrically connected by it to said metal housing.

2. A slide switch according to claim 1, in which said grounding contact is provided with a longitudinal slot registering with said housing slot, the grounding contact slot being shorter than the housing slot, and the ends of the grounding contact slot forming said abutments.

3. A slide switch according to claim 1, in which said abutments are tabs projecting through said housing slot.

4. A slide switch according to claim 3, one of said tabs being spaced from the adjacent end of the housing slot and from said button when the other abutment engages the opposite end of the slot.

5. A slide switch comprising an elongated case formed from a metal housing provided with an insulating base, a row of three fixed electric contacts inside the case spaced apart lengthwise of said base and rigidly mounted thereon, an insulating slider inside the case movable lengthwise thereof, a bridging contact movable by the slider from a position bridging the middle stationary contact and either of the end stationary contacts to a position bridging the middle contact and the other end contact, and a metal grounding contact in the case in engagement with said housing and movable by the slider into engagement with one end contact when the bridging contact is moved into engagement with the other end contact, said grounding contact being a metal strip having a body portion disposed between said slider and the side of said housing opposite said base, and said strip being provided with a resilient end portion extending across the end of the slider adjacent said one end contact and having a free end for engaging that contact, whereby the end contact engaged by the grounding contact is electrically connected by it to said metal housing.

6. A slide switch according to claim 5, in which said end portion of the grounding contact crosses the adjoining end face of said insulating base when the grounding contact is out of engagement with said one end contact.

7. A slide switch according to claim 5, in which said body portion of said metal strip is provided near each end with a transversely extending ridge engaging said side of said housing.

8. A slide switch comprising an elongated case formed from a metal housing provided with an insulating base, two spaced parallel rows of fixed electric contacts inside the case with three contacts in each row spaced apart lengthwise of said base and rigidly mounted thereon, an insulating slider inside the case movable lengthwise thereof, a pair of spaced parallel bridging contacts movable by the slider from a position in which each bridging contact bridges the middle stationary contact and either of the end stationary contacts in the adjoining row to a position bridging the middle contact and the other end contact in the same row, and a metal grounding contact in the case in engagement with said housing and movable by the slider into engagement with both end contacts at one end of said rows when the bridging contacts are moved into engagement with the other two end contacts, whereby the end contacts engaged by the grounding contact are electrically connected by it to said metal housing.

* * * * *